United States Patent [19]

Swieskowski

[11] 4,356,653

[45] Nov. 2, 1982

[54] FIREARM MAGAZINE

[75] Inventor: Henry P. Swieskowski, Sparta, N.J.

[73] Assignee: The United States of America as represented by the Secretary of the Army, Washington, D.C.

[21] Appl. No.: 176,950

[22] Filed: Aug. 11, 1980

[51] Int. Cl.[3] ..... F41C 25/04

[52] U.S. Cl. ..... 42/50

[58] Field of Search ..... 42/50, 18, 22, 6, 7

[56] References Cited

U.S. PATENT DOCUMENTS 2,441,735 5/1948 Warner ..... 42/50

*Primary Examiner*—Charles T. Jordan

*Attorney, Agent, or Firm*—Nathan Edelberg; Robert P. Gibson; Max Yarmovsky

[57] ABSTRACT

The present invention provides an improved firearm magazine with directed spring forces. A magazine tube is composed of a rectangular center section with a cylindrical housing section at each end of the tube. Helical springs are installed within the cylindrical sections to provide the biasing force required to feed rounds into a weapon. An alternate embodiment describes three cylindrical housing sections separated by two rectangular housing sections. The cylindrical housing sections are provided with the helical springs of unequal stiffness to provide a required unbalanced load distribution.

5 Claims, 4 Drawing Figures

FIREARM MAGAZINE

GOVERNMENTAL INTEREST

The invention described herein may be manufactured, used and licensed by or for the Government for Governmental purposes without the payment to me of any royalties thereon.

BACKGROUND OF THE INVENTION

The present invention relates to a field of the art dealing with a design of a firearm magazine.

The basic shortcoming in the prior art devices has related to an absence of an improved design of a magazine which is capable of precisely controlling the point of load application in the firearm.

A conventional type magazine with a rectangularly coiled spring faces a problem of excessive spring buckling and high stress concentrations at sharp radii of the spring which results in the spring failure. Further, the misplacement of load application in the conventional type magazine leads directly to override and stubround malfunctions in the firearms. The conventional magazine is very susceptible to buckling and distortion especially at the follower end, which shifts the point of load application to malfunctional areas. This load shifting occurs during burst firing when the spring is feeding and extending in an interrupted sequence. This problem has, in the prior art, proven to be a formidable one. Accordingly, the present invention is intended as a solution to said problem.

SUMMARY OF THE INVENTION

The present invention discloses an improved firearm magazine. The magazine tube is composed of a rectangular center portion with a cylindrical housing section at each end. Helical compression springs are installed within the cylindrical sections to provide the load required to feed the rounds into the weapon. A round is securely inserted in a groove of the magazine tube and a dog-bone shaped follower is provided between the springs and the round for guiding a motion of the round. In a second embodiment, the magazine tube is composed of at least three cylindrical housing sections and two rectangular housing sections. The cylindrical housing sections are provided with the helical compression springs of unequal stiffness to provide a required unbalanced load distribution. It is an object of the present invention to provide an improved firearm magazine capable of high efficiency and performance.

It is another object to avoid override and stub-round malfunctions associated with a conventional type magazine.

It is a further object to control a point of load application since the springs are localized within the magazine tube.

DETAILED DESCRIPTION OF THE INVENTION

Figure 1:
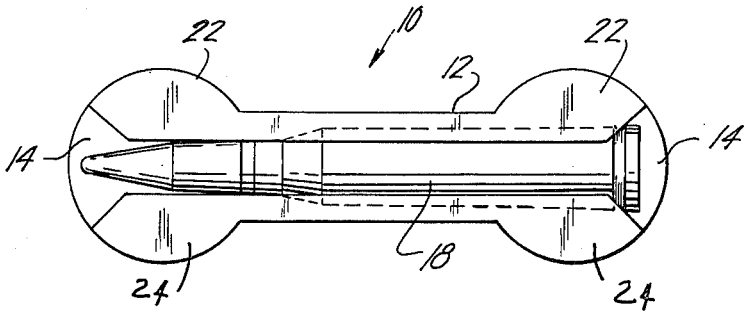
FIG. 1 is a top view of a magazine of the present invention.
Figure 2:
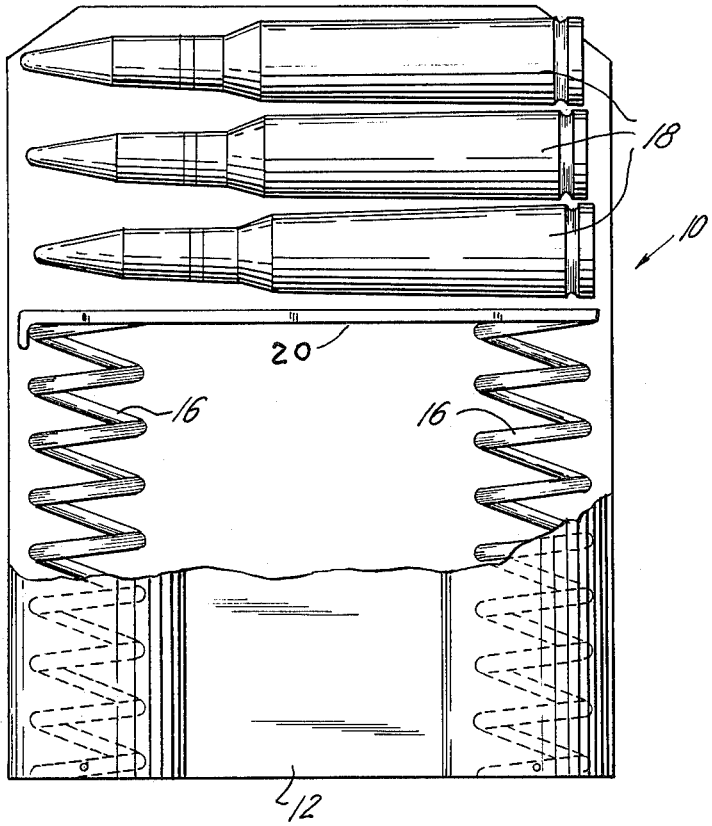
FIG. 2 is a front cut-away view of a magazine illustrating an arrangement of helical springs within cylindrical housings of the magazine tube.

As shown in FIG. 1, a magazine 10 is composed of a rectangularly shaped tube center section 12 having extended cylindrical housing sections 14 at opposite ends of the rectangular center section 12. These sections form an integrated magazine tube. As shown in FIG. 2, helical compression springs 16 are installed in the cylindrical housings 14 to provide the load required to feed the rounds 18 into a weapon, not shown. These helical springs 16 are closely secured within and along the walls of the cylindrical housings 14 so that they are restrained from buckling by the close fitting cylindrical walls. The helical springs 16 as arranged and shown in FIG. 2 eliminate the sharp radii and associated stress concentrations. The improved magazine 10 with helical springs 16 will enable spring forces to be localized and confined within the magazine 10.

A plurality of rounds 18 are axially aligned along the longitudinal axis of the magazine 10 by the parallel center sections 12. As shown in FIG. 2, a dog-bone shaped or a rectangular shaped follower-member 20 is interposed between the rounds 18 and the helical springs 16. The follower 20 transmits the spring forces properly to the rounds 18 and positions the top round correctly for a subsequent stripping operation. The rounds 18 are restrained from being ejected from the top end of magazine 10 by housing flange wall extensions 22 and 24.

Figure 3:
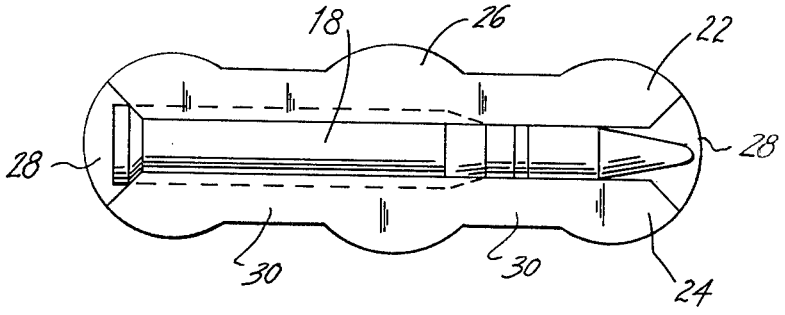
FIG. 3 is a top view of a magazine of an alternative embodiment of the present invention.
Figure 4:
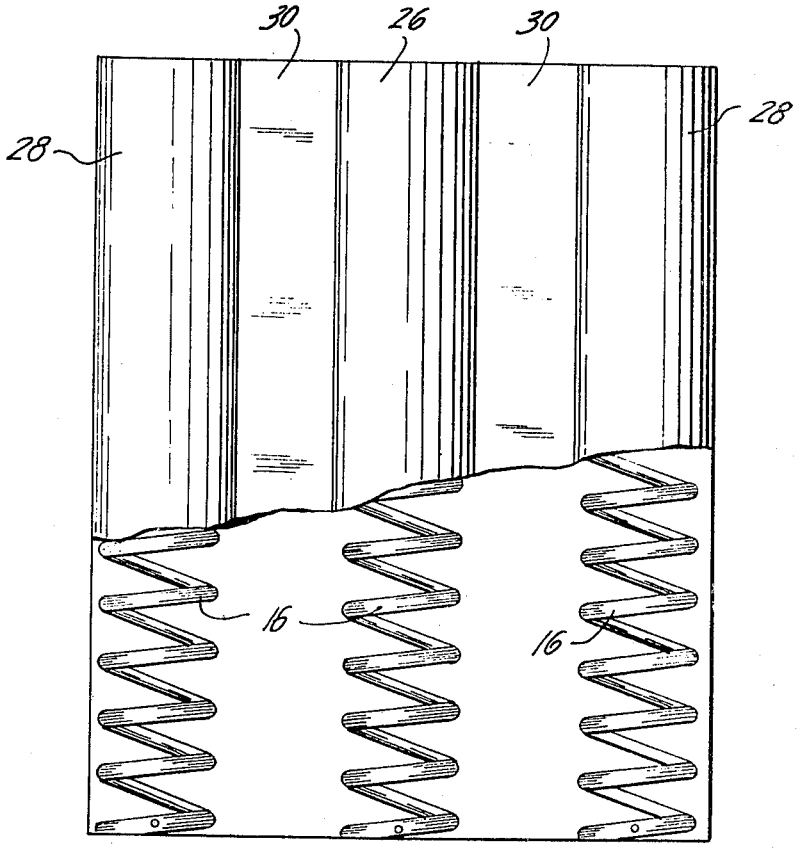
FIG. 4 is a front cut-away view of a magazine shown in FIG. 3.

In applications where increased spring loads are required for feeding, the magazine configuration as shown in FIGS. 3 and 4 is quite useful. In FIG. 3, three cylindrical housing sections are shown, a centrally located section 26 and at opposite ends thereof two cylindrical sections 28. Sections 26 and 28 are separated by rectangular sections 30 forming an integrated magazine tube. Helical springs 16 in FIG. 4 are closely secured within and along the walls of the cylindrical housings 26 and 28. The helical springs 16 may be designed to be of unequal stiffness to provide a required unbalanced load distribution.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

I claim:

1. An improved firearm magazine comprising:

(a) a housing having a rectangularly shaped center section, a cylindrical housing section operatively positioned at opposite ends of the rectangular center section forming an integrated magazine tube;

(b) at least one helical spring closely secured within and along the walls of each cylindrical housing section of the magazine tube;

(c) a plurality of rounds axially aligned along a longitudinal axis of said housing, securely engagable in a groove;

(d) a follower member interposed between the rounds and the helical springs for transmitting the spring forces to the rounds and for positioning a top round operatively within said magazine.

2. An improved firearm magazine as recited in claim 1, in which the follower member is of a dog-bone shape and slidably fitted within the magazine tube.

3. An improved firearm magazine having helical compression springs, wherein the improvement comprises:

a rectangular center portion of the magazine having cylindrical housing sections at opposite ends of the rectangular portion forming an integrated magazine tube in which said helical springs are closely secured within and along the walls of said cylindrical housing sections of the magazine tube.

4. An improved firearm magazine having helical compression springs, wherein the improvement comprises:

at least three cylindrical housing sections, a single cylindrical section centrally positioned and two cylindrical sections positioned at opposite ends of the magazine, each of said sections being separated by a rectangular section forming an integrated magazine tube in which said helical springs are closely guided within said cylindrical housing sections.

5. An improved firearm magazine as recited in claim 4 in which said helical springs are of unequal stiffness to meet an unbalanced load distribution.

* * * * *